US008477086B2

(12) United States Patent
Miyamoto et al.

(10) Patent No.: US 8,477,086 B2
(45) Date of Patent: Jul. 2, 2013

(54) ORGANIC ELECTROLUMINESCENCE DISPLAY

(75) Inventors: Mitsuhide Miyamoto, Kawasaki (JP); Tohru Kohno, Kokubunji (JP); Masato Ishii, Tokyo (JP); Naruhiko Kasai, Yokohama (JP); Hajime Akimoto, Kokubunji (JP)

(73) Assignees: Hitachi Displays, Ltd., Chiba-ken (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 1148 days.

(21) Appl. No.: 12/068,524

(22) Filed: Feb. 7, 2008

(65) Prior Publication Data

US 2008/0218453 A1 Sep. 11, 2008

(30) Foreign Application Priority Data

Mar. 7, 2007 (JP) ..... 2007-057081

(51) Int. Cl.
*G09G 3/30* (2006.01)

(52) U.S. Cl.
USPC ..... 345/76

(58) Field of Classification Search
USPC ..... 345/77
See application file for complete search history.

(56) References Cited

U.S. PATENT DOCUMENTS 5,949,194 A * 9/1999 Kawakami et al. ..... 315/169.4
6,495,964 B1 * 12/2002 Muthu et al. ..... 315/149
2003/0071821 A1 * 4/2003 Sundahl et al. ..... 345/589
2004/0263444 A1 * 12/2004 Kimura ..... 345/82
2005/0259099 A1 * 11/2005 Jo et al. ..... 345/211
2005/0285822 A1 * 12/2005 Reddy et al. ..... 345/76
2006/0007204 A1 * 1/2006 Reddy et al. ..... 345/204
2006/0007205 A1 * 1/2006 Reddy et al. ..... 345/204
2006/0007206 A1 * 1/2006 Reddy et al. ..... 345/204
2006/0007248 A1 * 1/2006 Reddy et al. ..... 345/690
2006/0007249 A1 * 1/2006 Reddy et al. ..... 345/690
2006/0221015 A1 * 10/2006 Shirasaki et al. ..... 345/77

FOREIGN PATENT DOCUMENTS

JP 2002-341825 5/2001
JP 2005-156697 11/2003

* cited by examiner

*Primary Examiner* — Quan-Zhen Wang
*Assistant Examiner* — Nelson D Runkle, III
(74) *Attorney, Agent, or Firm* — Stites & Harbison PLLC; Juan Carlos A. Marquez, Esq.; Nicholas B. Trenkle, Esq.

(57) ABSTRACT

In an organic EL display, correction is made for a difference in screen luminance between the case of measuring characteristics of OLED elements, and the case of not measuring the characteristics of the OLED elements. A data line for feeding image data items, and a detection line for measuring the characteristics of the OLED elements are connected to respective pixels. Detection of the characteristics of the OLED elements is executed by utilizing a specified period of a frame period. Because an image-displaying period is limited in a frame where measurement of the characteristics of the OLED element 11 is executed, the luminance undergoes deterioration. In order to prevent the deterioration of the luminance, an analog-to-digital converter ADC causes γ characteristic of the OLED elements in the frame where measurement of the characteristics of 11 is executed to be varied by the agency of a signal from a timing controller Tcon to the analog-to-digital converter ADC, thereby increasing luminance intensity of light emission of the OLED elements.

17 Claims, 12 Drawing Sheets

ORGANIC ELECTROLUMINESCENCE DISPLAY

CLAIM OF PRIORITY

The present application claims priority from Japanese application JP 2007-057081 filed on Mar. 7, 2007, the content of which is hereby incorporated by reference into this application.

FIELD OF THE INVENTION

The invention relates to an organic electroluminescence (EL) display, and in particular, to a display technology for correcting variation in light-emission characteristics of the organic EL element, occurring along with the elapse of operation time.

BACKGROUND OF THE INVENTION

A CRT display used to be in the mainstream of conventional display devices, however, in place of the CRT display, a flat display, such as a liquid crystal display, plasma display, and so forth, has since been put to commercial use, and the demand for the flat display has been on the increase. Further, there have been advances in development and commercial use of a display utilizing organic electroluminescence {hereinafter referred to also as an organic EL display (OLED)}, and a display for forming images by disposing electron sources utilizing field emission in a matrix fashion to thereby shine florescent substances disposed at anodes (FED display).

The organic EL display has features in that since it is of a self-emission type in contrast to the liquid crystal display, a backlight is unnecessary (1), since a voltage necessary for emitting light is as low as 10 V, or less, there is a possibility of reducing power consumption (2), since a vacuum structure is unnecessary in contrast to the plasma display, and the FED display, the organic EL display is suited for reduction in weight, and lower profile (3), since response time is as short as several microseconds, the organic EL display is excellent in moving-picture characteristics (4), a viewing angle is as wide as 170 degrees, or wider (5), and so forth.

Thus, the organic EL display has the features described as above; however, one of problems with the organic EL display is a phenomenon that light-emission characteristics of organic EL elements (hereinafter referred to as OLED elements) vary along with the elapse of operation time. Further, there are cases where when a specific image is displayed for long time, variation in the characteristics of the OLED element appears as deterioration in the characteristics of part of the image only, so-called "image persistence". The phenomenon of the image persistence is quite conspicuous in comparison with the case of gradual decrease in luminance intensity of a screen as a whole. In order to prevent the image persistence from becoming conspicuous, it is necessary to detect the characteristics of the OLED elements for all images to thereby feedback results of detection to an input signal delivered from a host.

Variation in the characteristics of the OLED element shows itself as variation in voltage-current characteristics of the OLED element. In other words, even if an identical voltage is applied to the OLED element, current flowing therethrough will decrease in amperage along with operation time. This holds true for not only the case where the operation time refers to a long time period, such as a service life, during which deterioration occurs to the characteristics of the OLED element, but also the case where the operation time refers to a relatively short time period such as the case of the image persistence. This phenomenon is shown in FIG. 20. In FIG. 20, the horizontal axis indicates voltage applied to the OLED element, ad the vertical axis indicates current flowing therethrough. In the figure, a curve A indicates initial characteristics of the OLED element, and a curve B indicates characteristics thereof after the elapse of time. Since light emission of the OLED element may be considered proportional to current flowing therethrough, luminance intensity of light emission of the OLED element undergoes variation along with the elapse of time even if an identical voltage is applied thereto, resulting in failure for displaying an accurate image.

Conversely, it follows that in order to cause an identical current to flow for causing identical light emission, it is necessary to apply a higher voltage. FIG. 21 shows variation in applied voltage, necessary for causing the same current to flow through the OLED element. In FIG. 21, the horizontal axis indicates operation time, and the vertical axis indicates applied voltage for causing a constant current to flow through the OLED element. FIG. 21 shows that the applied voltage should be increased in order to cause the identical current to flow through the OLED element.

As described above, with the organic EL display, in order to effect displaying of correct images, it is necessary to periodically measure the voltage-current characteristics of the OLED elements for all pixels to be thereby fed back to image signals as inputted. Reference literatures describing such technologies as described include JP-A No. 2005-156697, and JP-A No. 2002-341825.

SUMMARY OF THE INVENTION

In those conventional technologies described as above, there are described a method whereby all the OLED elements are measured at a time on a frame-by-frame basis, or for every several frames, or a method whereby measurement of the OLED elements is executed by dividing one frame into a light emission period portion, and a measurement period portion with respect to all the frames, and so forth. Because a screen is made up of a multitude of the OLED elements, it takes fairly long time to execute measurement of all the OLED elements. Since light emission for image formation is not executed by the respective OLED elements during this time period, there occur effects on luminance of images.

With those conventional technologies, no consideration is given to the effects on luminance of a screen, due to measurement on the OLED elements. More specifically, if measurement is executed on the light emission characteristics of the organic EL elements in respect of all the frames, luminance intensity of light emission undergoes deterioration. Further, if all the frames are put to alternate use on a frame-by-frame basis, or on the basis of every several frames for measurement on the OLED elements, this will cause deterioration in luminance intensity of the screen, and a flicker as the case may be.

The invention has been developed in order to cope with the problem described as above, and it is an object of the invention to enable measurement on OLED elements while preventing a screen from appearing unnatural.

The invention intends to solve the problem described, and a frame is classified into a frame where detection of characteristics of OLED elements is executed and a frame where the detection of the characteristics of the OLED elements is not executed. A period for forming an image is secured even in the frame where the detection of the characteristics of the OLED elements is executed. A period of time for light emission of the OLED elements, for formation of an image, is shorter in the frame where the detection of the characteristics is executed, as compared with that in the frame where the detection of the characteristics is not executed, and a power supply voltage for driving the OLED elements is increased to an extent of shortness in the period of time. With adoption of such a configuration described as above, it becomes possible to secure equivalent luminance for all the frames, thereby enabling a natural image to be obtained. Specific means are described as follows.

(1) A display having a screen including plural pixels formed in a matrix fashion, each pixel having an OLED element, in which an image displayed by the display is composed of a first frame having a period for displaying an image, and a period for executing detection of characteristics of the OLED elements, and a second frame for displaying an image but not executing the detection of the characteristics of the OLED elements.

(2) The display described under (1) as above, in which a scanning frequency for displaying an image in the first frame is higher than a scanning frequency for displaying an image in the second frame.

(3) The display described under (1) as above, in which the detection of the characteristics of the OLED elements in the first frame is executed in a blanking period.

(4) The display described under (1) as above, in which intensity of light emission of the OLED elements in a period for forming the image in the first frame is higher than intensity of light emission of the OLED elements in a period for forming the image in the second frame.

(5) The display described under (1) as above, in which a relationship between gradation of the OLED elements and intensity of light emission thereof in a period for forming the image in the first frame differs from a relationship between gradation of the OLED elements and intensity of light emission thereof in a period for forming the image in the second frame.

(6) The display described under (1) as above, in which a power supply voltage for the OLED elements in a period for forming the image in the first frame is higher than a power supply voltage for the OLED elements in a period for forming the image in the second frame.

(7) The display described under (1) as above, further including a display scanning circuit for forming the image, and a detection scanning circuit for detecting the characteristics of the OLED elements.

(8) The display described under (7) as above, in which the detection of the characteristics of the OLED elements in the first frame is executed in a blanking period.

(9) The display described under (7) as above, in which a relationship between gradation of OLED elements and intensity of light emission thereof in a period for forming the image in a first frame differs from a relationship between gradation of the OLED elements and intensity of light emission thereof in a period for forming the image in second frame.

(10) The display described under (7) as above, in which a power supply voltage for OLED elements in a period for forming the image in a first frame is higher than a power supply voltage for the OLED elements in a period for forming the image in a second frame.

(11) The display having a screen comprising plural pixels formed in a matrix fashion, each pixel having an OLED element, the display further comprising a display scanning circuit for forming an image, and a detection scanning circuit for detecting characteristics of the OLED elements, in which the image displayed by the display includes a frame having a period for displaying the image, and a period for executing detection of the characteristics of the OLED elements, the detection of the characteristics of the OLED elements is executed on a scanning line-by-scanning line basis, and a relationship between gradation of the OLED elements and intensity of light emission thereof on a scanning line where the detection of the characteristics of the OLED elements is executed differs from a relationship between gradation of the OLED elements and intensity of light emission thereof on a scanning line where the detection of the characteristics of the OLED elements is not executed.

(12) The display described under (11) as above, in which a power supply voltage for the OLED elements on the scanning line where the detection of the characteristics of the OLED elements is executed is higher than a power supply voltage for the OLED elements on the scanning line where the detection of the characteristics of the OLED elements is not executed.

(13) The display described under (11) as above, in which the image displayed by the display includes the frame having the period for displaying the image, and the period for executing the detection of the characteristics of the OLED elements, and a second frame for displaying an image but not executing the detection of the characteristics of the OLED elements.

(14) A display having a screen comprising plural pixels formed in a matrix fashion, each pixel having an OLED element, in which an image displayed by the display comprises a first frame having a period for reading image data items into the pixels, respectively, a period for displaying an image, and a period for executing detection of characteristics of the OLED elements, and a second frame for not executing the detection of the characteristics of the OLED elements even though the second frame has a period for reading image data items into the pixels, respectively, and a period for displaying an image.

(15) The display described under (14) as above, in which intensity of light emission of the OLED elements in the period for forming the image in the first frame is higher than intensity of light emission of the OLED elements in the period for forming the image in the second frame.

(16) The display described under (14) as above, in which a relationship between gradation of the OLED elements and intensity of light emission thereof in the period for forming the image in the first frame differs from a relationship between gradation of the OLED elements and intensity of light emission thereof in the period for forming the image in the second frame.

(17) The display described under (14) as above, in which a power supply voltage for the OLED elements in the period for forming the image in the first frame is higher than a power supply voltage for the OLED elements in the period for forming the image in the second frame.

With the use of the means described as above, the detection of the characteristics of all the OLED elements on a screen can be executed, and luminance in all the frames will become equivalent, so that a natural image can be maintained. Each of the means has the following effect.

With the means under (1) as above, there exist the frame for executing the detection of characteristics of the OLED elements, and the other frame for not executing the detection of the characteristics of the OLED elements, and displaying of the image is executed even in the other frame for not executing the detection of the characteristics of the OLED elements, so that the effect of the detection of the characteristics of the OLED elements on displaying of the image can be rendered limited.

With the means under (2) as above, the scanning frequency for forming the image in the frame for executing the detection of the characteristics of the OLED elements is rendered higher, so that it is possible to secure a period for the detection of the characteristics.

With the means under (3) as above, the blanking period is utilized for the detection of the characteristics of the OLED elements, so that it is possible to make effective use of the blanking period.

With the respective means under (4) to (6) as above, the intensity of the light emission of the OLED elements in the period for forming the image in the frame for executing the detection of the characteristics of the OLED elements is rendered higher, thereby eliminating a difference in luminance between the frames, so that it is possible to form a natural image.

With the respective means under (7) to (10) as above, the detection scanning circuit is installed besides the display scanning circuit, so that it is possible to execute the detection of the characteristics of the OLED elements in the frame for executing the detection of the characteristics of the OLED elements.

With the respective means under (11) to (13) as above, the detection of the characteristics of the OLED elements is executed on the scanning line-by-scanning line basis, and the intensity of the light emission of the OLED elements on the scanning line where the detection of the characteristics of the OLED elements is executed is rendered higher than the intensity of the light emission of the OLED elements on the scanning line where the detection of the characteristics of the OLED elements is not executed, so that it is possible to avoid a phenomenon that the line on which the detection of the characteristics of the OLED elements is executed becomes darker.

With the respective means under (14) to (17) as above, there exist the first frame having the period for reading the image data items into the pixels, respectively, the period for displaying the image, and the period for executing the detection of the characteristics of the OLED elements, and the second frame for not executing the detection of the characteristics of the OLED elements even though the second frame has the period for reading the image data items into the pixels, respectively, and the period for displaying the image, so that the effect of the detection of the characteristics of the OLED elements on displaying of the image can be rendered limited. Further, the intensity of the light emission of the OLED elements in the frame where the detection of the characteristics of the OLED elements is executed is rendered higher than the intensity of the light emission of the OLED elements in the frame where the detection of the characteristics of the OLED elements is not executed, so that it is possible to eliminate a difference in luminance between the respective frames, thereby enabling a natural image to be formed.

DETAILED DESCRIPTION OF THE PREFERRED EMBODIMENTS

The content of the invention is described in detail hereinafter with reference to embodiments thereof.

Embodiment 1

Figure 1:
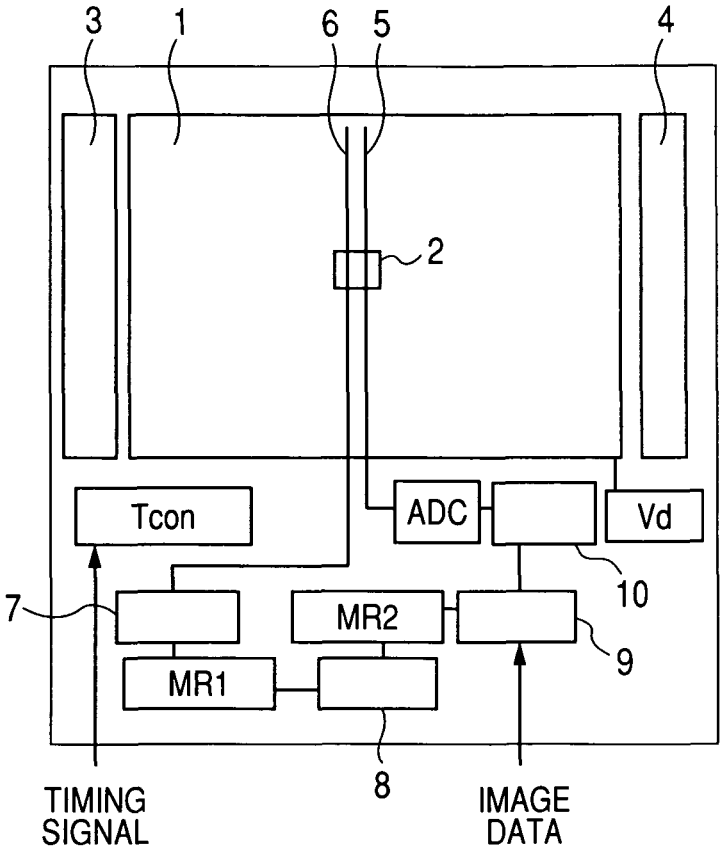
FIG. 1 is a block diagram of a display according to an embodiment 1 of the invention.
Figure 2:
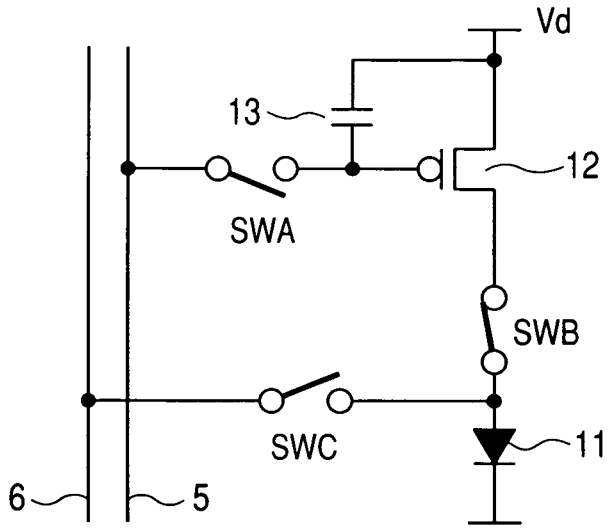
FIG. 2 is a circuit diagram of a pixel according to the embodiment 1 of the invention.

FIG. 1 is a block diagram showing an organic EL display according to an embodiment 1 of the invention. FIG. 2 shows a makeup of a pixel 2 shown in FIG. 1. A multitude of the pixels 2 are disposed in a matrix fashion in a display region 1. The respective pixels are provided with an anode, a cathode, an OLED element 11 having an organic EL light-emitting layer, sandwiched between the anode and the cathode, a thin-film transistor (TFT) for driving the OLED element 11, a storage capacitor, and so forth. A display scanning circuit 3 for scanning a screen surface on a row-by-row basis to thereby form an image is disposed on the left-hand side of the display region 1. That is, image data items are fed from a signal drive circuit to a selected row.

A detection scanning circuit 4 for detecting characteristics of the OLED elements 11 is disposed on the right-hand side of a screen. Detection of the characteristics of the OLED elements 11 is executed in order to measure voltage-current characteristics of each of the OLED elements, and such measurement is executed on a row-by-row basis. Scanning for the purpose of the measurement is executed independently from scanning for the purpose of formation of the image.

A data line 5 for feeding an image signal, and a detection line 6 for measuring the characteristics of the OLED element 11, that is, the voltage-current characteristics thereof are connected to the respective pixels. FIG. 2 shows a drive circuit of a pixel part. In FIG. 2, an OLED drive TFT 12, a B-switch SWB, and an OLED element 11 are series-connected between a power supply Vd and a reference potential. Herein, the reference potential represents a wide concept including earth ground. The B switch SWB is provided to determine whether or not current for the purpose of light emission is caused to flow to the OLED element 11, and is generally made up of a TFT switch. A control signal is sent out from the display scanning circuit 3 to the B switch SWB.

In FIG. 2, the OLED drive TFT 12 is a TFT for controlling amperage of current flowing to the OLED element 11 in order to decide gradation of the image. When an A switch SWA in FIG. 2 is closed, the image signal from the signal drive circuit is captured. Upon closing of the A switch SWA, the image signal is captured in a storage capacitor 13. A gate voltage of the OLED drive TFT 12 is dependent on charge accumulated in the storage capacitor 13, and the amperage of the current flowing to the OLED element 11 is thereby decided. Herein, when the B-switch SWB is closed, current flows to the OLED elements 11 to thereby emit light, whereupon an image is formed. When the image signal is captured in the storage capacitor 13, the A switch SWA is opened, and a signal voltage is retained in the storage capacitor 13 for a period of one frame until the relevant scanning line is selected.

In FIG. 2, a C switch SWC is installed between the anode of the OLED element 11, and a detection line 6. The C switch SWC as well is generally made up of a TFT. The C switch SWC is kept open during a period when current for image formation is flowing to the OLED element 11. At the time of the detection of the characteristics of the OLED element 11, the C switch SWC is closed while the B-switch SWB is opened, thereby detecting the voltage-current characteristics of the OLED element.

Figure 3:
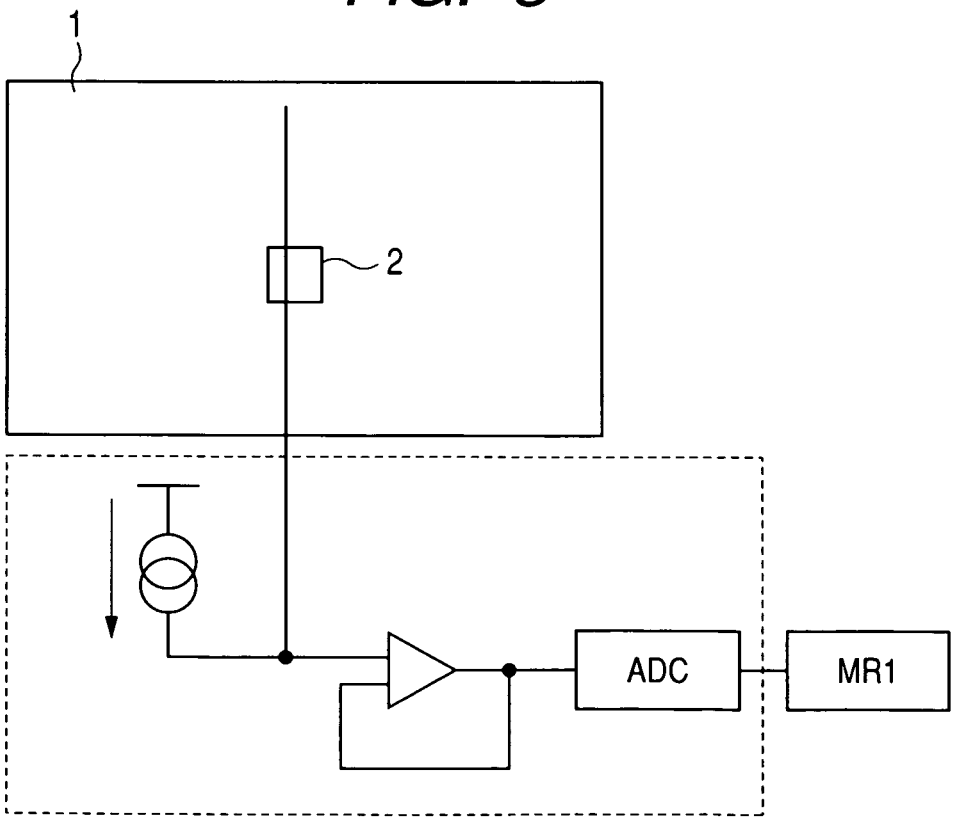
FIG. 3 is a view showing an example of a circuit for detecting characteristics of OLED elements.

The detection of the characteristics of the OLED element 11 is carried out by a detector 7 in FIG. 1. A method for detecting the characteristics of the OLED element 11 includes methods shown in FIGS. 3 and 4, respectively. FIG. 3 shows the case where a constant current source is installed in the detector 7. That is, constant current is fed from the constant current source present in the detector 7 to the respective pixels via the detection line 6. If degradation occurs to the OLED element 11, resistance of the OLED element 11 will increase, resulting in an increase in voltage across terminals of the OLED element 11. In other words, an anode voltage of the OLED element 11 rises. The anode voltage is detected to be then amplified by a differential amplifier. The anode voltage is converted into digital data by an analog-to-digital converter ADC, and the digital data is stored in a first memory MR1. Results of detection on the pixels corresponding to one line are accumulated in the first memory MR1.

Figure 4:
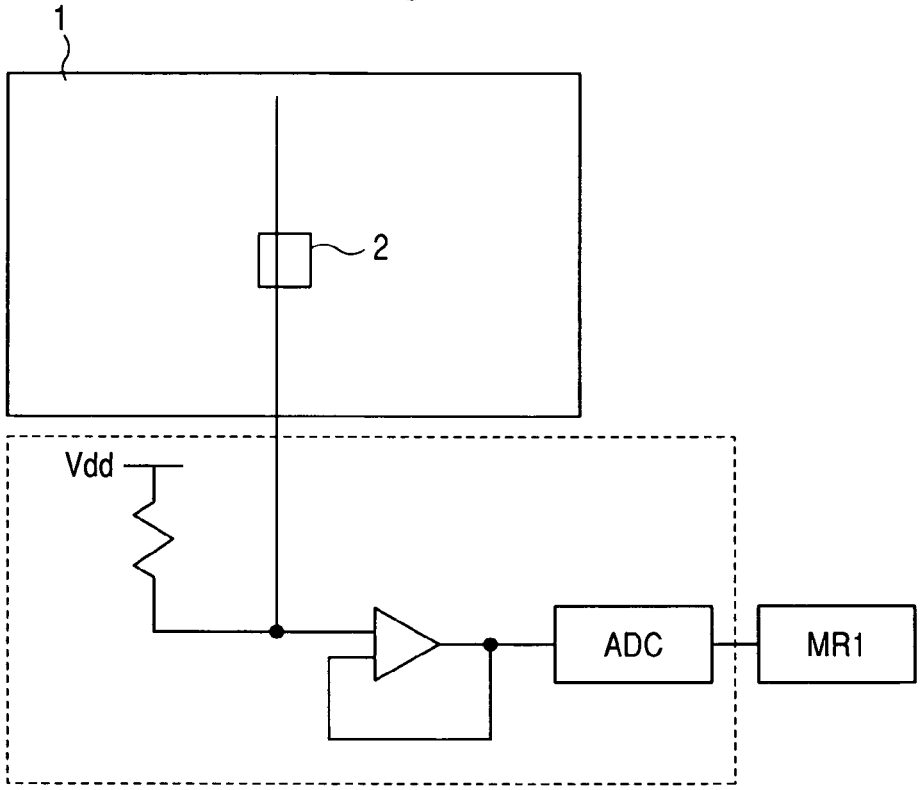
FIG. 4 is a view showing another example of the circuit for detecting the characteristics of the OLED elements.

FIG. 4 shows the case where a constant voltage source Vdd is installed in the detector 7. As is the case with the constant current source, if degradation occurs to the OLED element 11, the resistance will increase, so that the anode voltage of the OLED element 11 rises. The anode voltage is detected to be then amplified by a differential amplifier. The anode voltage is converted into digital data by the analog-to-digital converter ADC, and the digital data is stored in the first memory MR1. The results of detection on the pixels corresponding to one line are accumulated in the first memory MR1 as in the case of using the constant current source.

The detection is executed on a line-by-line basis, and all data items on respective lines are accumulated in the first memory MR1. A determination unit 8 refers to the characteristics of the OLED elements, accumulated in the first memory MR1, thereby determining deterioration conditions of the respective OLED elements. As to a determination method, it is possible to determine a degree of deterioration occurring to the respective pixels by comparing the characteristics thereof with, for example, voltage-current characteristics of a reference pixel as separately prepared. Otherwise, if adjacent pixels with the characteristics thereof already detected, present on one line, are compared with each other, this also will enable a difference in deterioration of the characteristics between the pixels to be determined. This method is effective in detecting the phenomenon of the image persistence, in particular.

Upon the determination unit 8 making a determination on a necessary correction amount through operation described as above, results of the determination are recorded in a second memory MR2. Data items corresponding to one line are inputted to an operation unit 9 shown in FIG. 1. The operation unit 9 refers to the second memory MR2, and adds the correction amount to data from the host, thereby preventing effects of the image persistence, and so forth from appearing on a displayed image. Image data items corresponding to one row, as corrected by the operation unit 9, are retained by a latch 10, and the image data items corresponding to one line, en bloc, are transferred.

At a point in time when an image data block is outputted from the latch 10, the image data block is digital data. The digital data digitally expresses luminance gradation. It is the analog-to-digital converter ADC that actually converts the digital data into a voltage to be applied to the OLED element 11. The voltage from the analog-to-digital converter ADC, to be applied to the respective pixels, is transferred to the respective pixels via the data line 5. An operation described as above is controlled by a timing controller Tcon. An anodic voltage from the power supply Vd is fed to the respective OLED elements 11 of all the pixels in FIG. 1.

Figure 5:
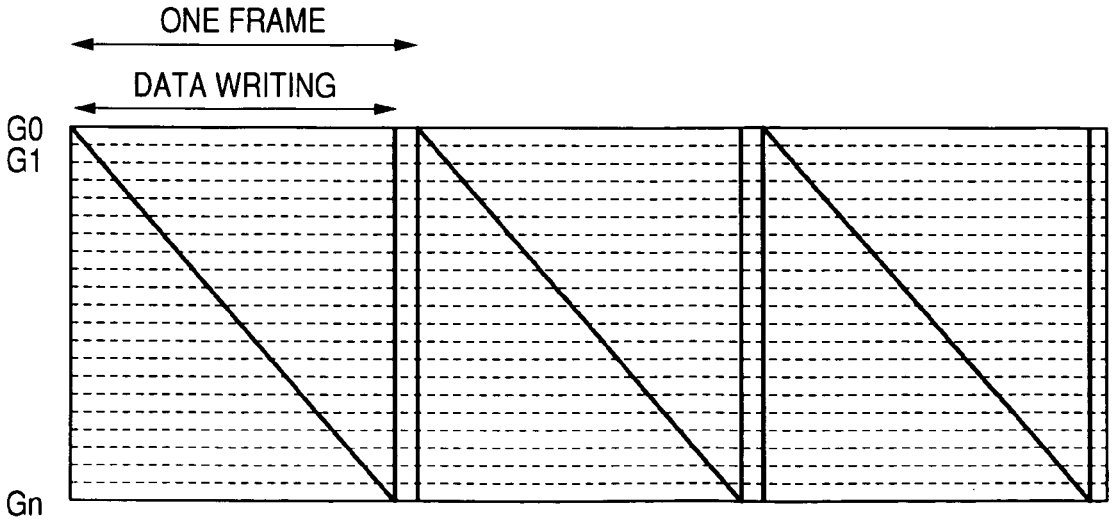
FIG. 5 is a schematic illustration showing an operation in frames where detection of the characteristics of the OLED elements is not executed

FIG. 5 is a view showing the state of writing of the image data items, and light emission in the case of normal displaying. One frame period is divided into a data-write period, and a blanking period. There exist (n+1) lengths of scanning lines sequentially denoted from the top by G0 to Gn, respectively. A slanting line indicates a state in which the image data items are sequentially written by starting from the top. As described with reference to FIG. 2, upon selection of each of the scanning lines, the A switch SWA is closed, and image data items are written to the storage capacitor 13. Upon writing of the image data items, the A switch SWA in FIG. 2 is opened while the B-switch SWB is closed, whereupon the OLED element 11 starts light emission, maintaining light emission for a period of one frame.

In FIG. 5, the blanking period corresponds to a line-revert period in the case of a CRT display. In the case of the organic EL display, the line-revert period is unnecessary, however, a little time length prior to transfer to a new frame is required in the drive circuit, and this time length is referred to as the blanking period.

There are cases where the blanking period is used for measurement on the OLED element 11, and so forth. In the case of using the blanking period for the purpose other than light emission for image formation by the OLED element 11, it need only be sufficient to open the B-switch SWB in FIG. 2. Then, if the B-switch SWB is closed again after completion of an operation as required, the OLED element 11 will execute the same light emission as executed before opening the B-switch SWB. This is because a gate potential of the OLED drive TFT 12 is retained by the storage capacitor 13.

Figure 6:
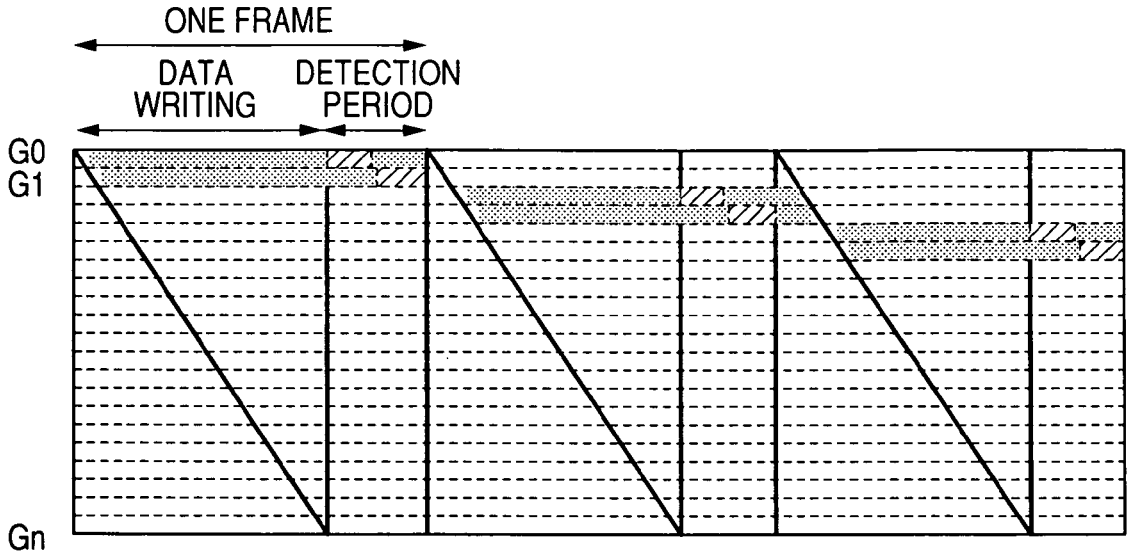
FIG. 6 is a schematic illustration showing an operation in frames where the detection of the characteristics of the OLED elements is executed.

FIG. 6 shows an operation in the case of executing the detection of the characteristics of the OLED element 11 during the blanking period. In FIG. 6, the detection of the characteristics is executed during the blanking period. Since given time is required for the detection of the characteristics, longer time is allocated to the blanking period in FIG. 6 than time allocated in the case of the blanking period in FIG. 5. Further, if the detection of the characteristics is executed for all the pixels 2 of one frame, a time length for light emission executed by the OLED element 11 will become very short. Accordingly, in FIG. 6, the detection of the characteristics is executed for the pixels only on the scanning lines G0 and G1, respectively, in a first frame. Thereafter, for example, the detection of the characteristics is executed for the pixels on the scanning lines G2 and G3, respectively, in a second frame, thereby implementing execution of the detection of the characteristics for all the pixels through plural frames.

As is evident by comparison of FIG. 5 with FIG. 6, there exists a difference in a period of time for light emission of the OLED element 11 between a frame in which the detection of the characteristics of the OLED element 11 is executed, and a frame in which the detection of the characteristics of the OLED element 11 is not executed. If that is the case, luminance of a screen of the frame in which the detection of the characteristics of the OLED element 11 is executed differs from that of a screen of the frame in which the detection of the characteristics of the OLED element 11 is not executed, thereby creating a factor for formation of an unnatural image. Such a difference will increase when there is a further increase in the number of the pixels 2 as measured per one frame. Further, because the period of time for the light emission of the OLED element 11, in the frame where the detection of the characteristics is executed, is shorter as compared with that in the frame where the detection of the characteristics is not executed, a scanning rate of the scanning by the display scanning circuit 3 for image display is higher than that in the case of the frame in which the detection of the characteristics is not executed.

Figure 7:
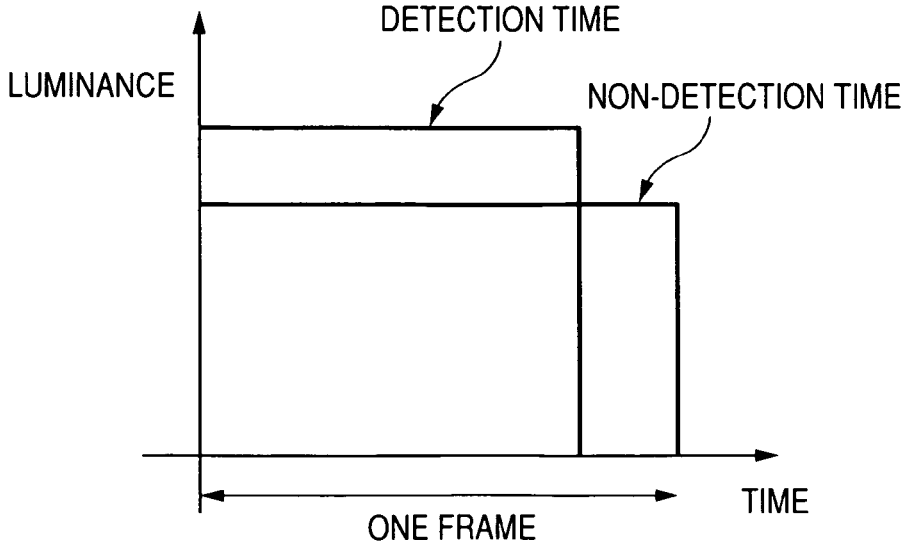
FIG. 7 is a diagram showing a difference in luminance intensity of light emission between the OLED elements in different frames by way of example.

With the present embodiment, in order to eliminate a problem of the difference in luminance, occurring between the respective frames, luminance intensity of light emission of the OLED element 11 is increased in the case of executing the detection of the characteristics of the OLED element 11 as compared with the case of not executing the detection of the characteristics thereof. This state is shown in FIG. 7. As shown in FIG. 7, when the detection on the OLED elements 11 is not executed, the respective OLED elements 11 execute light emission throughout one frame, but when the detection on the OLED elements 11 is executed, there occurs no light emission from the respective OLED elements 11 corresponding to a detection period, therefore increasing luminance intensity of the OLED elements 11 in that case.

Figure 8:
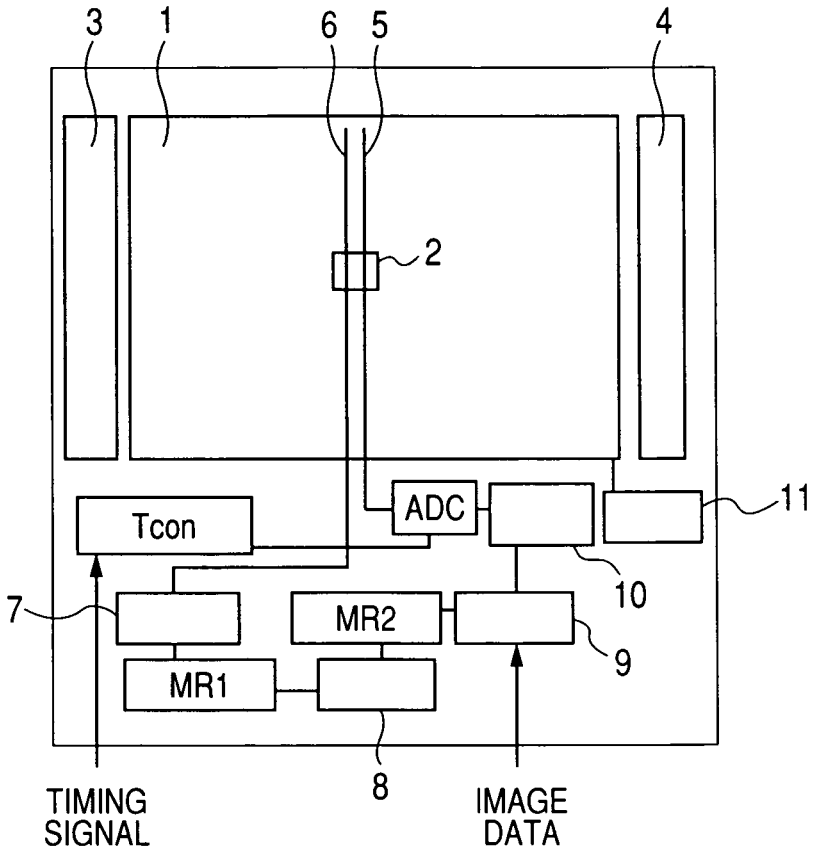
FIG. 8 is a view showing an example for varying luminance intensity of the light emission of the OLED elements in the display.

FIG. 8 shows an example of means for varying luminance intensity of light emission of the OLED elements 11 at the time of detecting the characteristics of the OLED elements 11 from that at the time of not detecting the characteristics of the OLED elements 11. In FIG. 8, a signal indicating whether the relevant frame is a frame where the detection of the characteristics of the OLED element 11 is executed or a frame where the detection of the characteristics of the OLED element 11 is not executed is sent out from the timing controller Tcon to the analog-to-digital converter ADC. At the analog-to-digital converter ADC, γ characteristic of the frame for the detection of the characteristics is varied from γ characteristic of the frame for non-detection of the characteristics. Herein, the γ characteristic refers to a curve in Cartesian coordinates in which the horizontal axis indicates gradation, and the vertical axis indicates luminance. In the frame where the detection of the characteristics of the OLED element 11 is executed, the γ characteristic tends to start rising up earlier.

Figure 9:
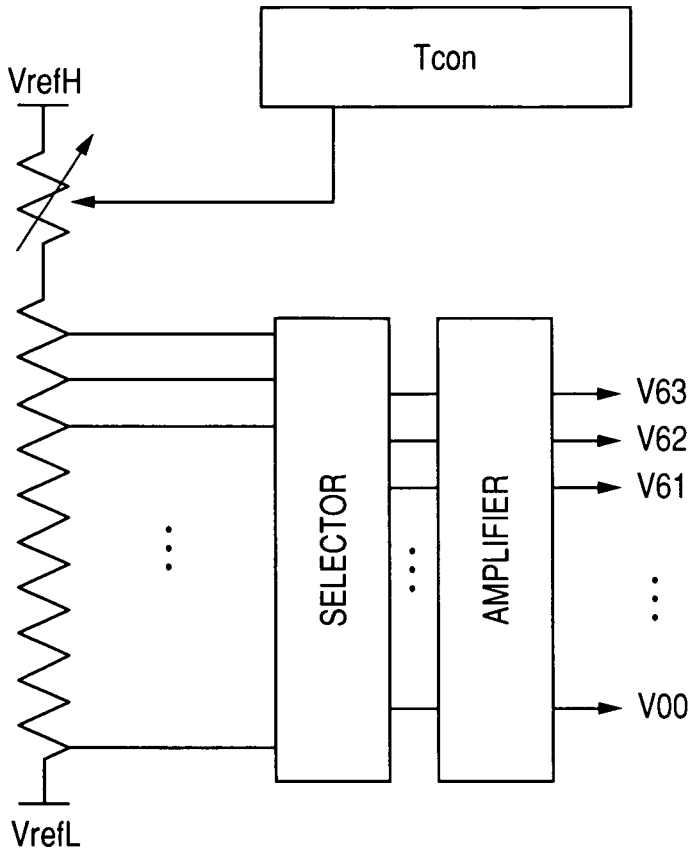
FIG. 9 is a view showing a specific example for varying the luminance intensity of the light emission of the OLED elements.
Figure 10:
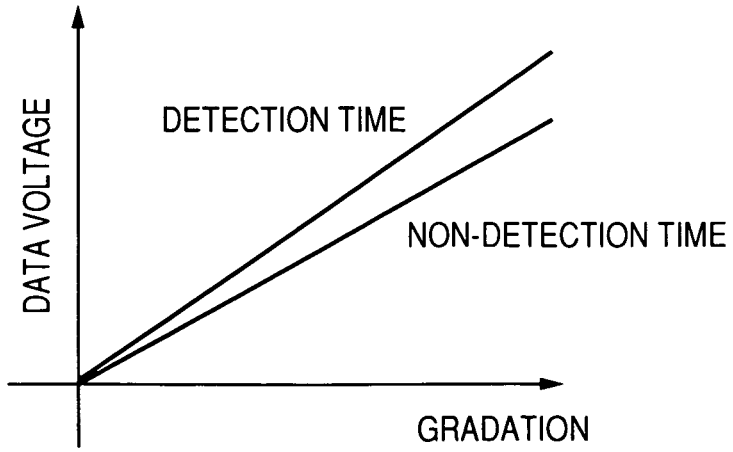
FIG. 10 is a view showing another example for varying the luminance intensity of the light emission of the OLED elements in the display.

Formation of the γ characteristic of gradation and luminance is effected by dividing a ladder resistor. FIG. 9 shows the case where respective voltages applied to 64 pieces of liquid crystal pixels are provided by dividing the ladder resistor. In FIG. 9, a voltage applied to the OLED element 11, for each of gradations, at the time of the detection, is varied from that at the time of the non-detection by varying variable resistance, thereby varying the γ characteristic. In FIG. 9, respective data items outputted from an amplifier, corresponding to the respective voltages from V00 to V63, are respective gradation voltages, and FIG. 10 shows a gradation vs. voltage relationship. As shown in FIG. 10, the gradation voltage applied to each of the pixels is raised at the time for the frame where the detection of the characteristics of the OLED element 11 is executed, thereby raising a maximum luminance intensity of the frame at the time when the detection on the characteristics of the OLED elements 11 is executed.

Figure 11:
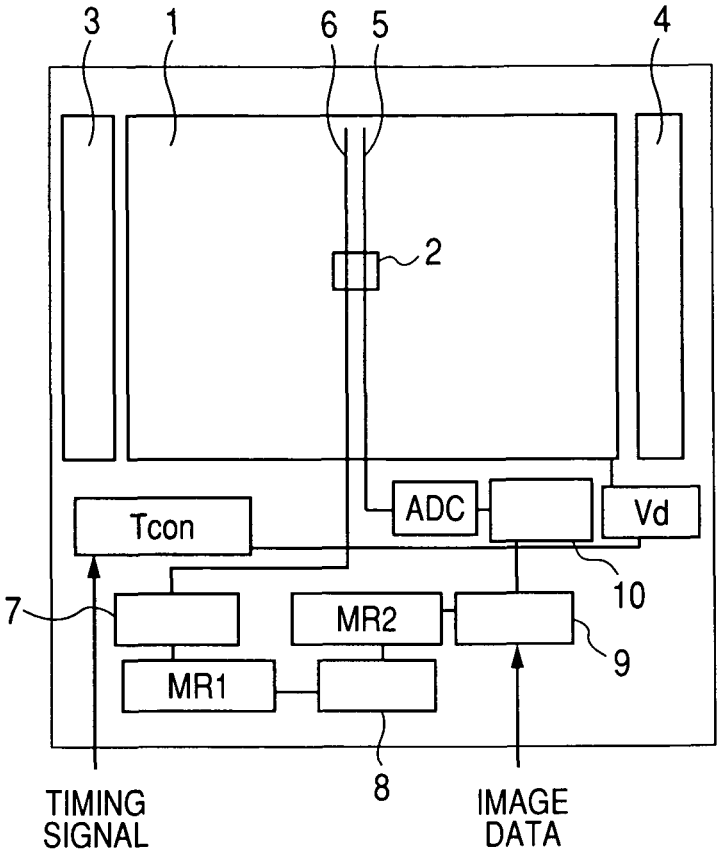
FIG. 11 is a view showing still another example for varying the luminance intensity of the light emission of the OLED elements.

Other methods for eliminating the problem of the difference in luminance, occurring between the frames, are to vary a power supply voltage at the time of the detection of the characteristics of the OLED element 11 from that at the time of the non-detection thereof, as shown in FIGS. 10 and 11, respectively. FIG. 10 shows the case where the power supply voltage is raised at the time for the frame where the detection of the characteristics of the OLED element 11 is executed, thereby raising a maximum luminance intensity of the frame at the time when the detection on the characteristics of the OLED elements 11 is executed. In FIG. 11, a signal for the detection or the non-detection is sent out from the timing controller Tcon to the power supply Vd. According to the signal from the timing controller Tcon, the power supply Vd is changed over to a high voltage side in the case of the frame where the characteristics of the OLED element 11 is detected, and to a standard voltage side in the case of the frame where the characteristics of the OLED element 11 is not detected.

Thus, with the present embodiment, any frame can secure an identical luminance intensity regardless of whether a frame is the frame where the characteristics of the OLED element 11 is detected or the frame where the characteristics of the OLED element 11 are not detected, so that a natural image can be formed.

Described as above is the case where the detection of the characteristics is executed during displaying of an image. For a specified time length immediately after the display is switch on, no image is displayed owing to the necessity of putting the display in readiness for operation, and so forth. If measurement is executed on the characteristics of the OLED elements 11 for all the pixels with the use of the display scanning circuit 4, and a detection circuit, according to the present embodiment, taking advantage of the specified time length, it is possible to execute the measurement of the characteristics without adversely affecting normal displaying of an image. And displaying with accurate gradation is enabled from the outset of image displaying.

Embodiment 2

Figure 12:
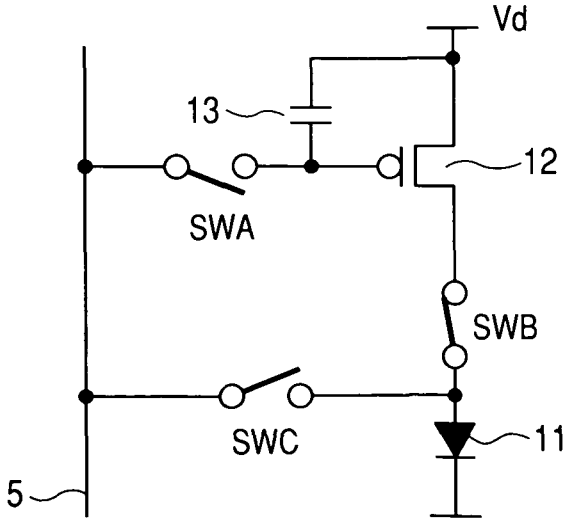
FIG. 12 is a circuit diagram of a pixel according to an embodiment 2 of the invention.
Figure 13:
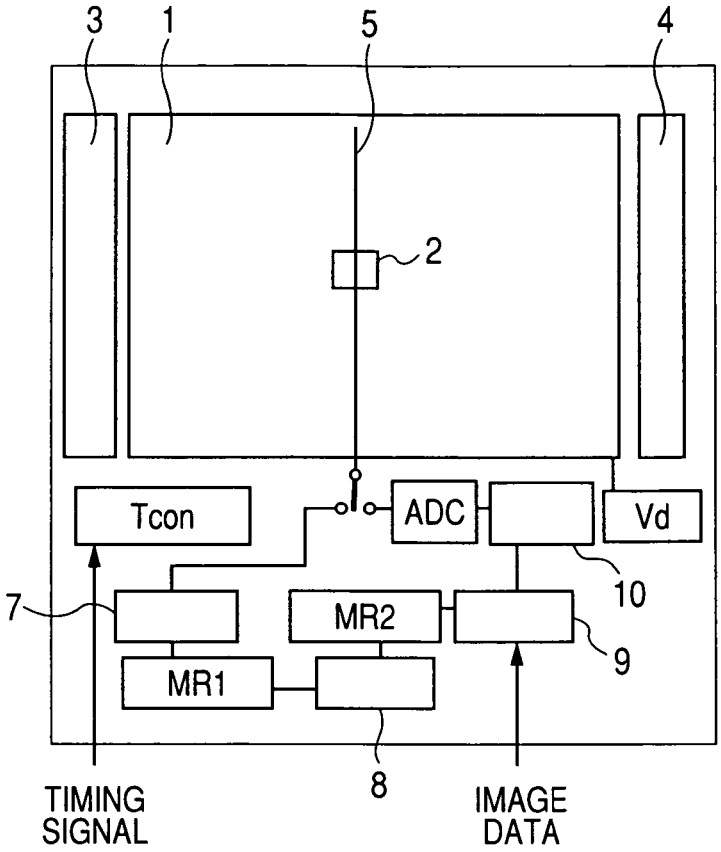
FIG. 13 is a block diagram of a display according to the embodiment 2 of the invention.

FIG. 12 shows a makeup of a pixel according to an embodiment 2 of the invention. In contrast to the pixel shown in FIG. 2, a detection line 6 is not present in the pixel shown in FIG. 12, and both an A switch SWA and a C switch SWC are connected to a data line 5. The makeup of the pixel according to the present embodiment is the same in other respects as that shown in FIG. 2. FIG. 13 is a block diagram showing an organic EL display according to the embodiment 2 of the invention, in whole, in the case of adopting the pixel shown in FIG. 12. In contrast to FIG. 1, the detection line 6 is not present in FIG. 13. The data line 5 has an AK switch SWAK for switch-over, provided outside a display region 1. The AK switch SWAK is connected to a side of the display, adjacent to an analog-to-digital converter ADC, at the time of displaying an image, and an image data block for formation of the image is fed to a pixel 2. The configuration of the display according to the present embodiment is the same in other respects as that shown in FIG. 1.

With the present embodiment, since a period of time for light emission of an OLED element 11, in a frame where detection of the characteristics of the OLED element 11 is executed, is shorter as compared with that in a frame where detection of the characteristics of the OLED element 11 is not executed, a scanning rate of scanning by the display scanning circuit 3 for displaying the image is higher than that in the case of the frame where the detection of the characteristics of the OLED element 11 is not executed. Accordingly, the display scanning circuit 3 according to the present embodiment should have a variable scanning frequency.

In the case of executing detection of the characteristics of the pixel 2, the AK switch SWAK is connected to a side of the display, adjacent to a detector 7, thereby executing the detection of the characteristics of the pixel 2. A process for the detection of the characteristics is the same as that described in the embodiment 1. As is the case with the embodiment 1, longer time is allocated for blanking in the frame where the detection of the characteristics of the OLED element 11 is executed, resulting in deterioration in luminance of a screen. With the present embodiment as well, in order to compensate for that, luminance intensity of light emission of the respective OLED elements 11 can be increased in the frame where the detection of the characteristics of the OLED element 11 is executed in the same way as for the case of the embodiment 1. Further, as to means for increasing the luminance intensity of the light emission of the OLED element 11, either a method of varying the $\gamma$ characteristic at an analog-to-digital converter ADC by the agency of a signal from a timing controller Tcon, or a method for varying a power supply voltage may be adopted.

As described above, with the present embodiment, even in the case of an organic EL display without the detection scanning circuit 4, and the detection line 6, it is possible to execute the detection of the characteristics of the OLED element 11, and also, to eliminate a difference in luminance, between occasions for execution of the detection of the characteristics, and non-execution thereof, respectively, thereby enabling a natural image to be obtained.

Described as above is the case where the detection of the characteristics is executed during displaying of an image. Immediately after the display is switch on, no image is displayed for a specified time length owing to the necessity of putting the display in readiness for operation, and so forth. If the specified time length is utilized, and measurement is executed on the characteristics of the OLED elements 11 for all the pixels by connecting the AK switch SWAK installed at the data line 5 provided outside the display region 1 according to the present embodiment to the side of the display, adjacent to the analog-to-digital converter ADC, and with the use of the display scanning circuit 3, and a detection circuit, it is possible to execute the measurement of the characteristics without adversely affecting normal displaying of an image. And displaying with accurate gradation is enabled from the outset of image displaying.

Embodiment 3

Figure 14:
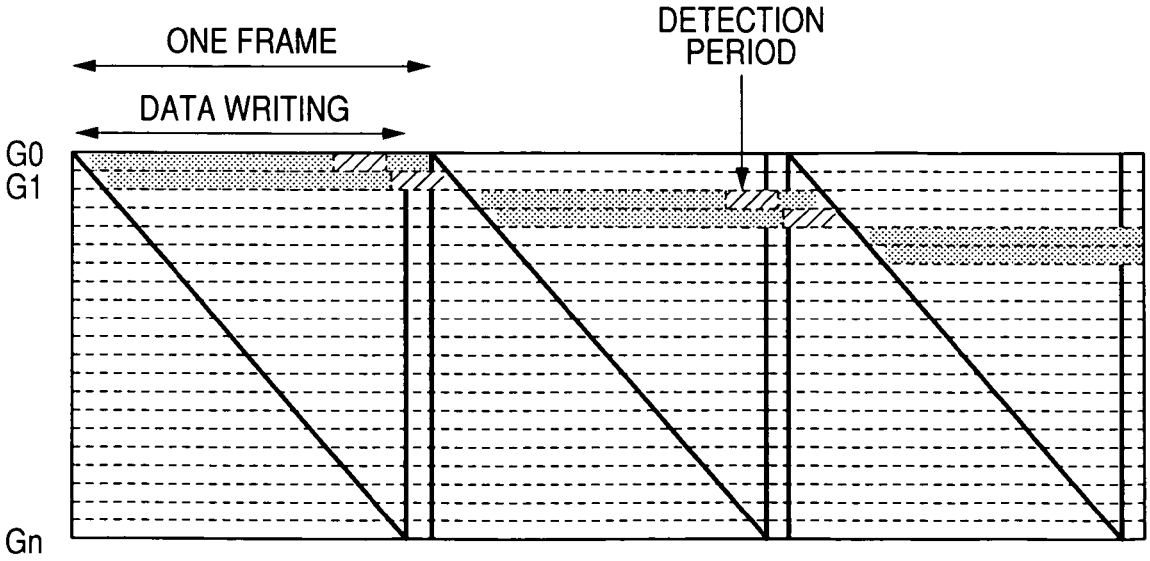
FIG. 14 is a schematic illustration showing an operation in a frame for executing the detection of the characteristics of the OLED elements according to an embodiment 3 of the invention.

FIG. 14 shows an operation according to an embodiment 3 of the invention. In FIG. 14, there is shown the case where detection of characteristics of OLED elements 11 for all pixels is executed not only in a blanking period but also in a displaying period. Circuits enabling frames in FIG. 14 to be driven are the same as those in FIG. 1 showing the organic EL display in whole, according to the embodiment 1, and FIG. 2 showing a pixel drive circuit. Accordingly, the present embodiment is described with reference to FIGS. 1 and 2.

In FIG. 14, scanning lines G0 to Gn are formed on a screen. The scanning lines are sequentially scanned from the scanning line G0 by a display scanning circuit 3, thereby forming an image. With the present embodiment, since it is not the case where the blanking period is used particularly for the detection of the characteristics of the OLED elements 11, the blanking period is not set long as compared with a period at non-detection time.

Upon selection of a first scanning line, followed by writing of data items, a B switch SWB shown in FIG. 2 is closed, and the OLED elements 11 emit light. Subsequently, upon selection of a second scanning line, followed by writing of data items, pixels corresponding to the second scanning line emit light. Thus, an operation for writing of the data items, and light emission are executed as far as the scanning line Gn.

With the present embodiment, there is executed the detection of the characteristics of the OLED elements 11 on two lengths of the scanning lines per one frame. The operation for light emission on the first scanning line G0 is stopped before scanning of one frame is completed, thereby executing measurement of the characteristics of the OLED elements 11 corresponding to the first scanning line G0. At that time, the B-switch SWB shown in FIG. 2 is opened, and flow of current for formation of an image to the OLED elements 11 is stopped. Thereafter, the C switch SWC is closed by the agency of a signal from a detection scanning circuit 4, thereby enabling the detection of the characteristics of the OLED elements 11 by the agency of a signal from a constant current source of a detector 7, or a low voltage source thereof.

An operation whereby results of detection on one scanning line, obtained in this way, are reflected on image signals of the OLED elements 11 is the same as that in the case of the embodiment 1. Upon completion of the detection for all the OLED elements 11 on the first scanning line, there is executed the detection of the characteristics of the OLED elements 11 on the second scanning line. Data items of the OLED elements 11 on the second scanning line are similarly reflected on correction of an image signal from a host.

The present embodiment has a feature in that the detection of the characteristics of OLED elements 11 on a specific scanning line is executed before completion of a write-operation for formation of an image with respect to all the scanning lines. This is rendered possible because the display is provided with the detection scanning circuit 4, and a detection line 6. That is, because selection of the scanning line for detection is made by use of the detection scanning circuit 4, which can be executed independently from scanning for displaying the image, to be implemented by a display scanning circuit 3.

With such a detection method as described, deterioration in luminance intensity in one frame represents only deterioration in luminance intensity occurring to one of the scanning lines, selected for measurement of the OLED elements, so that deterioration in luminance intensity per one frame will be insignificant. However, if the measurement of the OLED elements is executed on, for example, two scanning lines at a time on a frame-by-frame basis as shown in FIG. 14, it follows that luminance intensity corresponding to the two scanning lines will undergoes deterioration. Pixels corresponding to the two scanning lines are perceived as horizontal lines low in luminance intensity. Every time the horizontal lines low in luminance intensity move on the frame-by-frame basis, human eyes will be given an impression as if the horizontal lines were moving down from above, which is inconvenient.

Figure 15:
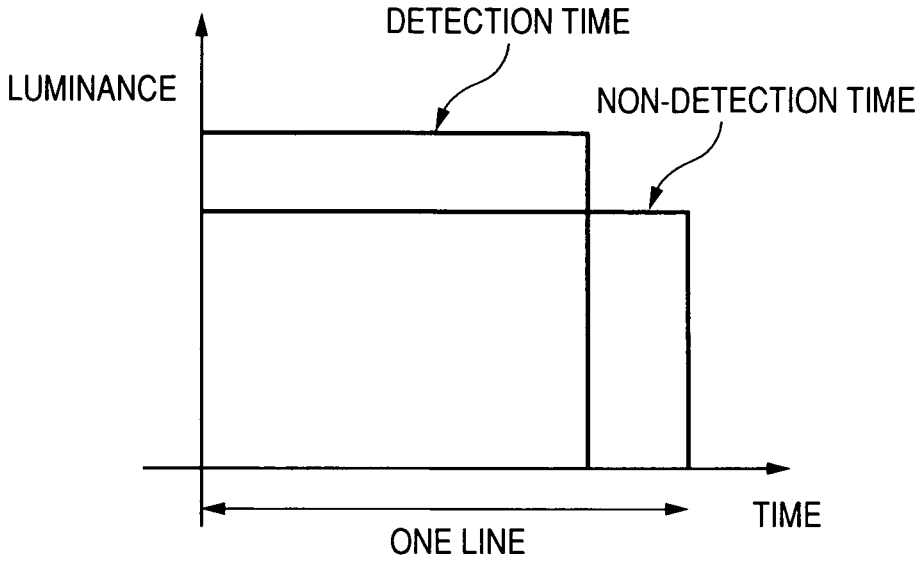
FIG. 15 is a diagram showing the case where the luminance intensity of the light emission of the respective OLED elements 11 is varied on a line-by-line basis.

With the present embodiment, the luminance intensity of the light emission of the respective OLED elements 11 in the case of detecting the characteristics of the OLED elements 11 on a scanning line-by-scanning line basis is varied from that in the case of not detecting the characteristics of the OLED elements 11 on the scanning line-by-scanning line basis as shown in FIG. 15. That is, the luminance intensity of the light emission of the OLED element 11 is increased on the scanning line where the measurement on the characteristics of the OLED elements 11 is executed. By so doing, it is possible to prevent a line of the OLED elements from being perceived as a dark line.

In the case of varying the luminance intensity of the light emission of the OLED elements 11 on the scanning line-by-scanning line basis, it is possible to execute an operation similar to that executed in the case of varying the luminance intensity of the light emission of the OLED elements 11 on the frame-by-frame basis. More specifically, as shown in FIGS. 8, and 9, in the case of the scanning line where the detection of the characteristics of the OLED elements 11 is executed, the γ characteristic of the analog-to-digital converter ADC is varied by the agency of the signal from the timing controller Tcon. Otherwise, the power supply voltage for the OLED elements 11 can be changed over by the agency of the signal from the timing controller Tcon.

Thus, with the present embodiment, the detection of the characteristics of the OLED elements 11 can be executed regardless of the blanking period, and degradation characteristics of the OLED elements 11 can be reflected on image data items without causing deterioration in luminance intensity, and occurrence of unnatural lines.

Embodiment 4

Figure 16:
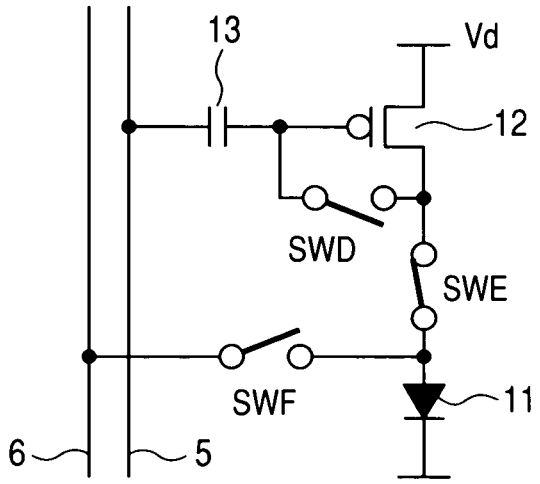
FIG. 16 is a circuit diagram of a pixel according to an embodiment 4 of the invention.
Figure 17:
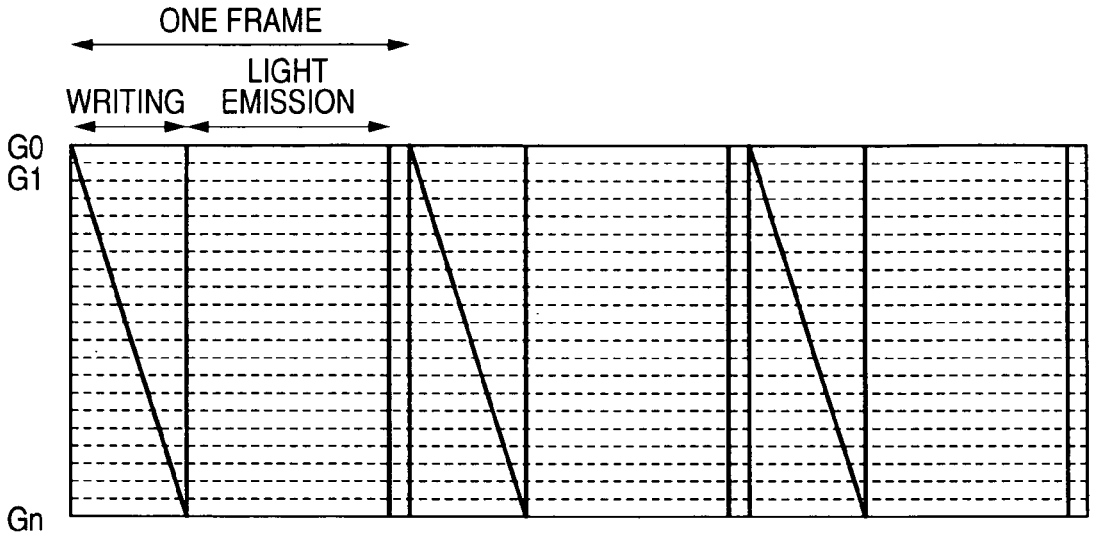
FIG. 17 is a schematic illustration showing an operation in frames where detection of the characteristics of the OLED elements is not executed according to the embodiment 4 of the invention.

FIG. 16 is a circuit diagram showing a makeup of a pixel according to an embodiment 4 of the invention. With the present embodiment, a drive period in one frame is divided into a write-period, and a light-emission period, as shown in FIG. 17. In FIG. 16 showing the same pixel drive circuit as used in the embodiment 1, current flowing to an OLED element 11 is controlled by a drive TFT, thereby enabling displaying with gradation. However, fluctuation occurs to the so-called threshold voltage Vth of a TFT depending on a process of manufacturing the TFT. In FIG. 16, image signals are accumulated in a storage capacitor 13. An effective gate voltage of an OLED drive TFT 12 is equal to a difference between a voltage dependent on charge accumulated in the storage capacitor 13, and the threshold voltage Vth of the OLED drive TFT 12. Accordingly, there are cases where the gate voltage of the OLED drive TFT 12 undergoes fluctuation under the influence of the threshold voltage Vth of the OLED drive TFT 12, thereby resulting in failure to effect displaying with accurate gradation.

The makeup of the pixel according to the present embodiment is intended to eliminate the fluctuation occurring to the threshold voltage Vth of the OLED drive TFT 12 to thereby enable displaying with accurate gradation. In FIG. 16, the OLED drive TFT 12, an E switch SWE, and an OLED element 11 are series-connected between a power supply Vd, and a reference potential. The E switch SWE is normally made up of a TFT. A D switch SWD made up of a TFT is connected between the drain and the gate of the OLED drive TFT 12. A storage capacitor 13 is installed between the gate of the OLED drive TFT 12, and a data line 5. Meanwhile, an F switch SWF normally made up of a TFT is installed between the anode of the OLED element 11, and a detection line 6.

An operation of the pixel in FIG. 16 is as follows. More specifically, when the pixel is selected by closing the D switch SWD, and the E switch SWE is closed for a short time period to thereby cause current to flow to the OLED drive TFT 12, and the OLED element 11, a gate voltage of the OLED drive TFT 12 after opening of the E switch SWE will converge to a potential corresponding to a power supply voltage minus the threshold voltage Vth of the OLED drive TFT 12. Upon selection of a scanning line, charge corresponding to image data items are written to the storage capacitor 13 of the pixel, however, the gate side of the storage capacitor 13 is fixed to a value equal to a power supply potential minus the threshold voltage Vth of the OLED drive TFT 12, so that charge based on the value equal to the power supply potential minus the threshold voltage Vth of the OLED drive TFT 12 is written to the storage capacitor 13. And the charge is retained until the pixel is selected next time.

After the image data items are written to all the pixels on a screen, respectively, a triangular wave is inputted to the data line 5, whereupon a time when the OLED drive TFT 12 is turned ON is decided according to magnitude of charge accumulated in the storage capacitor 13. Since the magnitude of the charge accumulated in the storage capacitor 13 reflects the image data items, and also reflects the threshold voltage Vth of the OLED drive TFT 12, the time when the OLED drive TFT 12 is turned ON will vary according to the image data items in a state where the threshold voltage Vth is compensated for, so that displaying with accurate gradation is enabled. Even if the makeup of the pixel is as shown in FIG. 16, an organic EL display according to the present embodiment has the same overall configuration as that shown in FIG. 1.

FIG. 17 shows a state of driving the present embodiment. In FIG. 17, (n+1) lengths of the scanning lines from G0 to Gn are formed. As described in the foregoing, the image data items are sequentially written to the respective pixels starting from the scanning line G0. The image data items as written are retained by the storage capacitor 13 in FIG. 16. Upon completion of writing the image data items to all the pixels, respectively, the E switch SWE is turned ON, whereupon all the pixels are in a state for enabling light emission. That is, with this method of driving, the pixels are in the black state in the write-period during the first half of one frame, and an image is formed in the light-emission period during the second half thereof. As is the case with the embodiments 1, and so forth, a short blanking period is provided between the respective frames.

Figure 18:
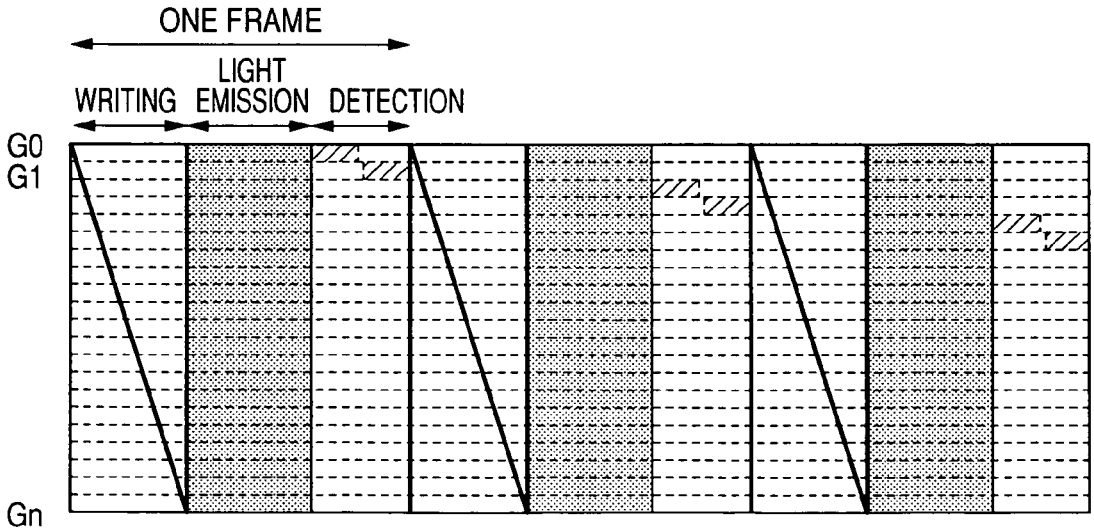
FIG. 18 is a schematic illustration showing an operation in frames where the detection of the characteristics of the OLED elements is executed according to the embodiment 4 of the invention.

FIG. 18 shows the case of executing measurement on the OLED elements 11 by utilizing the blanking period. In FIG.

18, the image data items are written to all the pixels, respectively, by first scanning all the scanning lines as is the case with FIG. 17. Thereafter, all the pixels are caused to emit light by closing the F switch SWF to thereby form an image. In FIG. 18, the characteristics of the pixels corresponding to two of the scanning lines, per one frame, are detected. Since it takes given time for the detection of the characteristics of the pixels, the light-emission period is restricted in length. More specifically, because an operation for eliminating fluctuation in the threshold voltage Vth of the OLED element 11 is required in the write-period for writing the image data items to the respective pixels, as described in the foregoing, it is difficult to shorten the write-period for writing the image data items to all the pixels, respectively. It follows therefore that the light-emission period is restricted.

If that is the case, a frame where the detection of the characteristics of the OLED element 11 is executed differs in luminance of a screen from a frame where the detection of the characteristics of the OLED element 11 is not executed, thereby creating a factor for formation of an unnatural image, as described with reference to the embodiment 1. As an organic EL display according to the present embodiment has the same overall configuration as that shown in FIG. 1, processing for the detection of the characteristics of the OLED element 11 can be executed by the same method as that in the case of the embodiment 1.

Accordingly, in the case of driving the present embodiment as well, it is possible to cope with the problem previously described by varying the luminance intensity of the light emission of the OLED elements 11 in the frame where the characteristics of the OLED elements 11 are detected from that for the OLED elements 11 in the frame where the characteristics of the OLED element 11 are not detected. For a configuration in which the luminance intensity of the light emission of the OLED elements 11 is varied, there can be adopted a method for varying the γ characteristic of gradation and luminance of the OLED elements 11 by the agency of the signal from the timing controller Tcon, as described with reference to FIGS. 8, and 9. Otherwise, a method for changing over the power supply voltage for the OLED elements 11 by the agency of the signal from the timing controller Tcon, as described with reference to FIG. 11, may be adopted.

Since the present embodiment is provided with a display scanning circuit 3, and the detection line 6, measurement of the characteristics of the OLED elements 11 can be executed independently form the writing of the image data items. This is because the scanning line can be selected by a detection scanning circuit 4 independently from the display scanning circuit 3. In this case, the measurement of the characteristics of the OLED elements 11 can be executed by not necessarily utilizing a blanking period. In addition, in this case, there occurs no inconvenience by giving an impression as if the horizontal lines were moving down from above, as described in the embodiment 3, because the measurement of the characteristics of the OLED elements 11 is executed when the pixels are in the black state of displaying.

Embodiment 5

Figure 19:
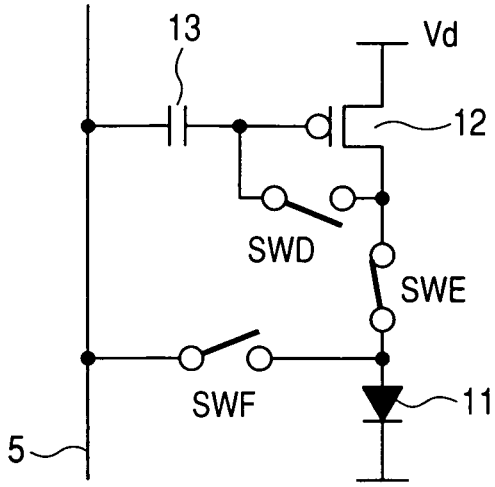
FIG. 19 is a circuit diagram of a pixel according to an embodiment 5 of the invention.
Figure 20:
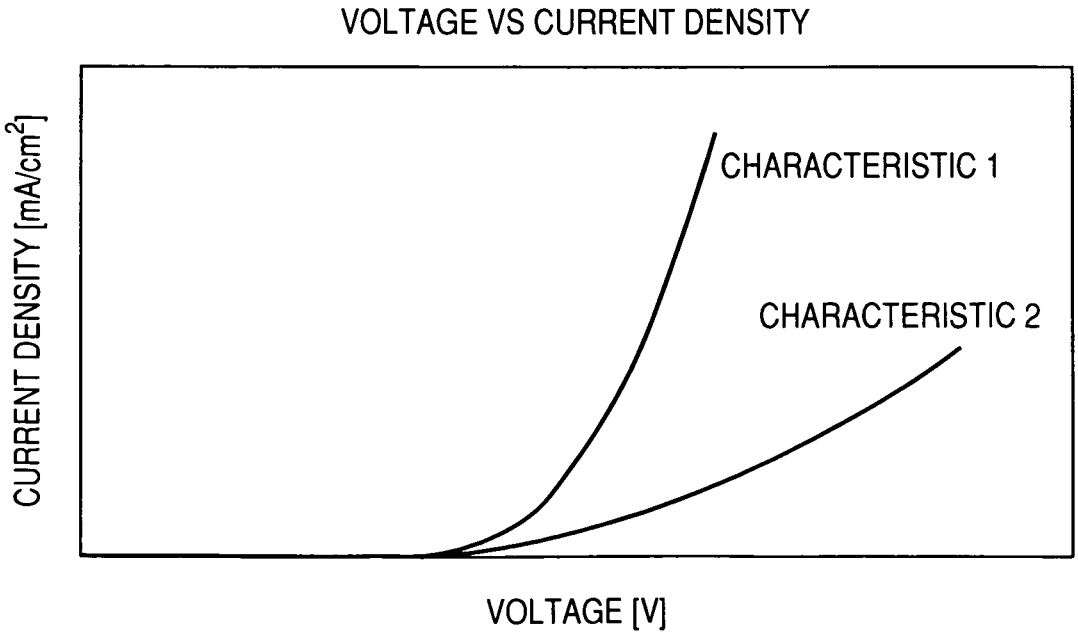
FIG. 20 is a diagram showing voltage-current characteristics of the OLED elements.
Figure 21:
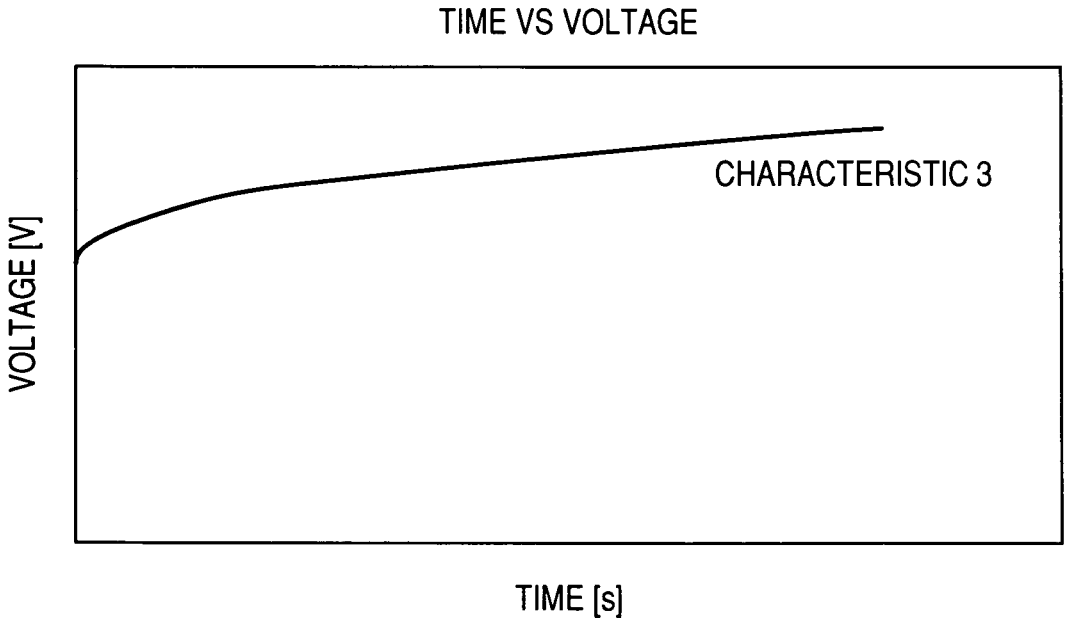
FIG. 21 is a graph showing an example of variation over time, in the characteristics of the OLED element.

FIG. 19 shows a makeup of a pixel for use in carrying out an embodiment 5 of the invention. In contrast to the makeup of the pixel shown in FIG. 16, the makeup of the pixel shown in FIG. 19 is not provided with a detection line 6, and an F switch SWF is connected to a data line 5. As is the case with the embodiment 4, it is possible to compensate for the fluctuation in the threshold voltage Vth of the OLED element 11 by an operation for resetting an OLED drive TFT 12. The configuration of an organic EL display according to the present embodiment, in the case of adopting the pixel shown in FIG. 19, is the same as that shown in FIG. 13. More specifically, since the data line 5 doubles as the detection line 6 in this case, an AK switch SWAK for switching over between an image data feed circuit, and a detection circuit is installed outside a display region.

A method for driving the present embodiment is the same as that shown in FIG. 17. That is, a first period of one frame is a write-period during which image data items are written to all pixels, respectively. All the pixels are in the black state of displaying in the write-period. By inputting a triangular wave to the data line 5 after the image data items are written to all the pixels, respectively, a light-emission start time of each of the pixels is controlled according to each of the image data items, thereby executing displaying with gradation. The AK switch SWAK is connected to a side of the display, adjacent to the data line, in a light-emission period as well as an image data write-period.

FIG. 18 is an operational diagram showing the case of detecting the characteristics of the OLED elements 11. In FIG. 18, one frame period is divided into an image data write-period, a light-emission period, and a detection period for utilizing a blanking period. An operation shown in FIG. 18 is the same as that described with reference to the embodiment 4. The AK switch SWAK in FIG. 13, is connected to a side of the display, adjacent to the data line, and the AK switch SWAK is connected to the detection circuit in a period for measuring the characteristics of the OLED elements.

With the present embodiment as well, since a frame where the detection of the characteristics of the OLED element 11 is executed differs in luminance intensity from a frame where the detection of the characteristics of the OLED element 11 is not executed, it is necessary to cope with the problem of the formation of the unnatural image as is the case with the embodiments 2, and so forth. Accordingly, in the case of driving the present embodiment as well, it is possible to cope with the problem described by varying luminance intensity of light emission of the OLED elements 11 in the frame where the characteristics of the OLED elements 11 are detected from that for the OLED elements 11 in the frame where the characteristics of the OLED element 11 are not detected. Further, for a configuration in which the luminance intensity of the light emission of the OLED elements 11 is varied, there can be adopted a method for varying the γ characteristic of gradation and luminance of the OLED elements 11 by the agency of the signal from the timing controller Tcon, as described with reference to FIGS. 8, and 9. Otherwise, a method for changing over a power supply voltage for the OLED elements 11 by the agency of the signal from the timing controller Tcon, as described with reference to FIG. 11, may be adopted.

What is claimed is:

1. A display device, comprising:

a display region having a plurality of pixels formed in a matrix fashion, each pixel having an OLED element; and wherein the display device is configured to display an image a first frame in the display region in a first frame period during which detection of characteristics of the OLED elements is executed and an image of a second frame in the display region in a second frame period during which detection of characteristics of the OLED elements is not executed;

the first frame period having a first display period during which the image of the first frame is displayed in the display region and a detection period during which detection of characteristics of the OLED elements is executed by detecting voltages across terminals of the OLED elements when a constant current is supplied to the OLED elements; and the second frame period having a second display period during which the image of the second frame is displayed in the display region and not having a detection period, the second display period being longer than the first display period;

a length of the first frame period is equal to a length of the second frame period, and detection of the characteristics of the OLED elements during the detection period is executed in a blanking period of the first frame period during which light is not emitted by the OLED elements that occurs immediately prior to writing of an image for a next frame after the first frame to the OLED elements.

2. The display device according to claim 1, wherein a scanning frequency for displaying the image of the first frame is higher than a scanning frequency for displaying the image of the second frame.

3. The display device according to claim 1, wherein intensity of light emission of the OLED elements in a period for forming the image of the first frame is higher than intensity of light emission of the OLED elements in a period for forming the image of the second frame.

4. The display device according to claim 1, wherein a relationship between gradation of the OLED elements and intensity of light emission thereof in a period for forming the image of the first frame differs from a relationship between gradation of the OLED elements and intensity of light emission thereof in a period for forming the image of the second frame.

5. The display device according to claim 1, wherein a power supply voltage for the OLED elements in a period for forming the image of the first frame is higher than a power supply voltage for the OLED elements in a period for forming the image of the second frame.

6. The display device according to claim 1, further comprising a display scanning circuit for forming images, and a detection scanning circuit for detecting the characteristics of the OLED elements.

7. The display device according to claim 6, wherein a relationship between gradation of OLED elements and intensity of light emission thereof in a period for forming the image of the first frame differs from a relationship between gradation of the OLED elements and intensity of light emission thereof in a period for forming the image of the second frame.

8. The display device according to claim 6, wherein a power supply voltage for OLED elements in a period for forming the image of the first frame is higher than a power supply voltage for the OLED elements in a period for forming the image of the second frame.

9. The display device according to claim 1, wherein, when executing detection of characteristics of the OLED elements, the display device displays a series of frames in first frame periods one after the other in a single respective first time period, and when displaying images without executing detection of characteristics of the OLED elements, the display displays a series of frames in second frame periods one after the other in a single respective second time period.

10. A display device, comprising:

a display region having a plurality of pixels formed in a matrix fashion, each pixel having an OLED element;

a display scanning circuit for forming an image; and a detection scanning circuit for detecting characteristics of the OLED elements by detecting voltages across terminals of the OLED elements when a constant current is supplied to the OLED elements, and wherein the display device is configured to display an image of a first frame in the display region in a first frame period during which detection of characteristics of the OLED elements is executed and an image of a second frame in the display region in a second frame period during which detection of the characteristics of the OLED elements is not executed;

the first frame period having a first display period during which the image of the first frame is displayed in the display region and a detection period during which detection of the characteristics of the OLED elements is executed, the second frame period having a second display period during which the image of the second frame is displayed in the display region and not having a detection period, the second display period being longer than the first display period, wherein detection of the characteristics of the OLED elements is executed on a scanning line-by-scanning line basis, and a relationship between gradation of the OLED elements and intensity of light emission thereof on a scanning line where detection of the characteristics of the OLED elements is executed differs from a relationship between gradation of the OLED elements and intensity of light emission thereof on a scanning line where detection of the characteristics of the OLED elements is not executed, and detection of the characteristics of the OLED elements during the detection period is executed in a blanking period of the first frame period during which light is not emitted by the OLED elements immediately prior to writing of an image for a next frame after the first frame to the OLED elements.

11. The display device according to claim 10, wherein a power supply voltage for the OLED elements on a scanning line where detection of the characteristics of the OLED elements is executed is higher than a power supply voltage for the OLED elements on a scanning line where detection of the characteristics of the OLED elements is not executed.

12. The display device according to claim 10, wherein, when executing detection of characteristics of the OLED elements, the display device displays a series of frames in first frame periods one after the other in a single respective first time period, and when displaying images without executing detection of characteristics of the OLED elements, the display displays a series of frames in second frame periods one after the other in a single respective second time period.

13. A display device, comprising:

a display region having a plurality of pixels formed in a matrix fashion, each pixel having an OLED element, and wherein the display device is configured to display an image of a first frame in the display region in a first frame period, said first frame period comprising a first read period, a first display period, and a detection period, said first read period for reading image data items into the pixels, respectively, said first display period for displaying the image of the first frame, and said detection period for executing detection of characteristics of the OLED elements by detecting voltages across terminals of the OLED elements when constant current is supplied, the display device is configured to display an image of a second frame in the display region in a second frame period during which detection of the characteristics of the OLED elements is not executed, said second frame period comprising a second read period and a second display period but not a detection period, said reading period for reading image data items into the pixels, respectively, and said second display period for displaying the image of the second frame, and detection of the characteristics of the OLED elements during the detection period is executed in a blanking period of the first frame period during which light is not emitted by the OLED elements immediately prior to writing of an image for a next frame after the first frame to the OLED elements.

14. The display device according to claim 13, wherein intensity of light emission of the OLED elements when forming the image of the first frame in the first frame period is higher than intensity of light emission of the OLED elements when forming the image of the second frame in the second frame period.

15. The display device according to claim 13, wherein a relationship between gradation of the OLED elements and intensity of light emission thereof when forming the image of the first frame in the first frame period differs from a relationship between gradation of the OLED elements and intensity of light emission thereof when forming the image of the second frame in the second frame period.

16. The display device according to claim 13, wherein a power supply voltage for the OLED elements when forming the image of the first frame in the first frame period is higher than a power supply voltage for the OLED elements when forming the image of the second frame in the second frame period.

17. The display device according to claim 13, wherein, when executing detection of characteristics of the OLED elements, the display device displays a series of frames in first frame periods one after the other in a single respective first time period, and when displaying images without executing detection of characteristics of the OLED elements, the display displays a series of frames in second frame periods one after the other in a single respective second time period.

* * * * *